US005325686A

United States Patent [19]

Bentley

[11] Patent Number: 5,325,686

[45] Date of Patent: Jul. 5, 1994

[54] WALL MOUNT GUN LOCK ASSEMBLY

[76] Inventor: James K. Bentley, 29100 N. Lower Valley Rd., Box 4645-21, Techachapi, Calif. 93561

[21] Appl. No.: 51,864

[22] Filed: Apr. 26, 1993

[51] Int. Cl.[5] ..... E05B 73/00

[52] U.S. Cl. ..... 70/58; 70/62; 70/40; 211/4; 248/551

[58] Field of Search ..... 70/18, 57, 58, 40, 62, 70/388; 248/551-553; 211/4, 13, 63, 64

[56] References Cited

U.S. PATENT DOCUMENTS

| | | | |
|---|---|---|---|
| 722,325 | 3/1903 | Plowden | 70/40 |
| 1,104,052 | 7/1914 | Lamb | 70/40 |
| 1,412,600 | 4/1922 | Baumstark | 70/40 |
| 1,428,810 | 9/1922 | Shoemaker | 70/62 |
| 1,520,975 | 12/1924 | Sterling | 70/40 |
| 2,668,645 | 2/1954 | Pease | 211/64 X |
| 4,813,252 | 3/1989 | Ray | 70/58 X |
| 4,936,531 | 6/1990 | Bauser | 211/64 X |
| 4,998,423 | 3/1991 | Hsu | 70/40 |
| 5,022,536 | 6/1991 | Pierson | 211/64 |
| 5,127,244 | 7/1992 | Myers | 70/32 X |

FOREIGN PATENT DOCUMENTS

| | | | |
|---|---|---|---|
| 2170994 | 8/1986 | United Kingdom | 211/64 |

*Primary Examiner*—Peter M. Cuomo

*Assistant Examiner*—Suzanne L. Dino

*Attorney, Agent, or Firm*—Charles C. Logan, II

[57] ABSTRACT

A wall mount gun lock assembly having an open loop ring housing and an open loop ring. The open loop ring housing is secured to the wall of a room by lag bolts passing through the rear wall of the open loop ring housing. The front wall of the open loop ring housing has a key lock housing that is removably mounted in an aperture therein and it can be locked in place. An arcuate shaped open loop ring has its opposite end tips passing through left and right side apertures of the front wall of the open loop ring housing. The end tips of the open loop ring have annular grooves formed adjacent their ends. The key lock housing has side walls having horizontal slots that engage the annular grooves of the open loop ring when the key lock housing is pushed in to its locking position. It is impossible to rotate the open loop ring once the key lock housing has been locked in position and it is also impossible to gain access to the lag bolts that are mounting the open loop ring housing to the wall of a room. By merely unlocking the key lock housing, the open loop ring can be rotated so that the open space between its end tips is located outside the open loop ring housing which allows the open loop ring to be either threaded through or removed from the trigger guard of a firearm.

10 Claims, 2 Drawing Sheets

WALL MOUNT GUN LOCK ASSEMBLY

THE BACKGROUND OF THE INVENTION

The invention relates to a locking assembly and more specifically to a wall mount gun lock assembly.

A major concern of owners of guns is the fact, children may gain unauthorized access to guns with the consequence of someone being injured or killed. Another major concern is the guns can be stolen from a person's house.

Presently there are gun lock devices on the market that have not been entirely satisfactory. Some of these lock into the trigger guard behind the trigger thereby preventing the trigger being pulled. Often times this device can be pried apart and removed. Other devices on the market allow the weapon to be secured to a wall structure. Gun cabinets that can be locked are often mounted on a wall and many of them have pane glass doors that can be broken and provide access to the guns.

It is an object of the invention to provide a novel wall mount gun lock assembly that can be easily installed and securely attached to the wall of a house.

It is another object of the invention to provide a novel wall mount gun lock assembly that is economical to manufacture and market.

It is a further object of the invention to provide a novel wall mount gun lock assembly that can be used to secure both handguns and rifles.

SUMMARY OF THE INVENTION

The novel wall mount gun lock assembly has been designed to lock firearms to a structure that would be extremely hard to remove from the wall of a building. The wall mount gun lock assembly has two major components, an open loop ring and an open loop ring housing.

The open loop ring is made of a hard material such as case hardened steel and it has an arcuate shape. Its opposite end tips are spaced apart a predetermined distance from each other. Annular grooves are formed adjacent each of the end tips. The space between the end tips is such that it is easy to thread either of the end tips through the trigger guard of a weapon such as a rifle or a revolver. This allows for easy removal of one of the firearms or easy locking of one of the firearms.

The open loop ring housing is preferably made of steel having a sufficient strength so that the interior cannot be easily penetrated. The open loop ring housing preferably has a substantially triangularly shaped top wall and bottom wall. The rear wall has a pair of vertically spaced apertures through which are passed lag bolts that are threaded into the studs in the corner of a room. The side walls of the open loop ring housing have laterally extending arm portions that have inwardly bent finger portions at their respective ends. These finger portions each have an opening or slot through which the open loop ring can be threaded. Additionally, the front wall of the open loop ring housing has a left side aperture and a right side aperture through which the open loop ring can be threaded. The front wall of the open loop ring housing has a key lock housing aperture therein. Extending rearwardly from this central aperture are vertical walls that also have apertures in them that allow the open loop ring to be rotated therethrough.

A keg lock housing has a cylinder lock mounted in its front wall. It has vertical side walls extending rearwardly therefrom and each of these walls have a recess or slot that matingly engages the respective annular grooves of the open loop ring. When the keg lock housing is pushed inwardly, the latch member of the lock will travel over the cam surface of the locking plate and drop downwardly to secure the keg lock housing in its locked position. When the key is actuated, the latch will withdraw and the springs mounted at the rear of the key lock housing will automatically eject it to an open position where it is captured against further travel. At this time the open loop ring can be rotated so that the predetermined open space between its respective end tips are outside the interior of the open loop ring housing thereby allowing for removal of the open loop ring from the trigger guard of a firearm.

DESCRIPTION OF THE PREFERRED EMBODIMENT

Figure 1:
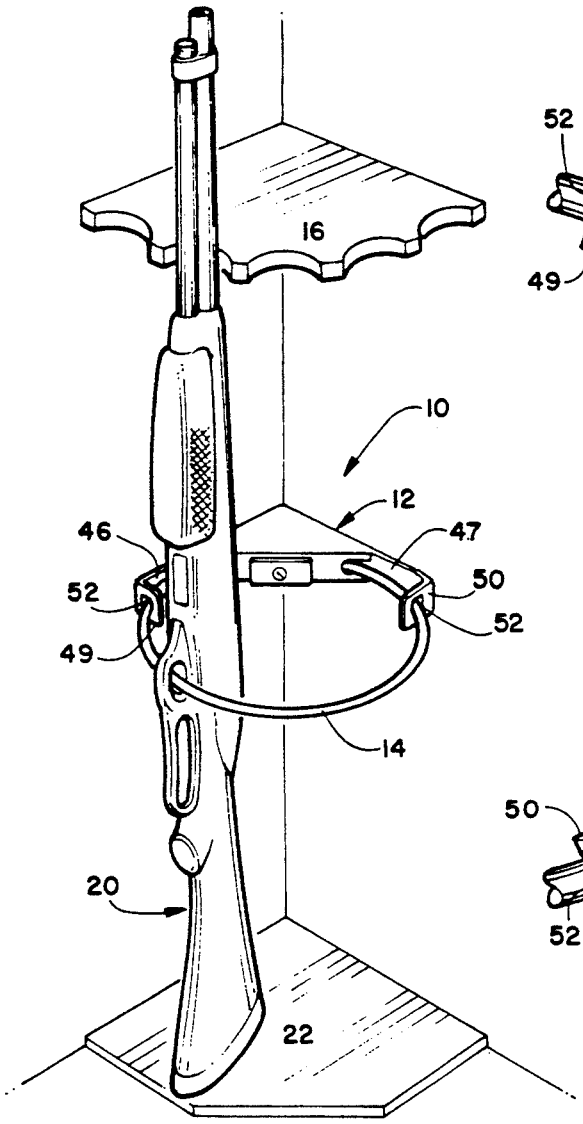
FIG. 1 is a front perspective view illustrating the novel wall mount gun lock assembly secured to the wall of a room.
Figure 3:
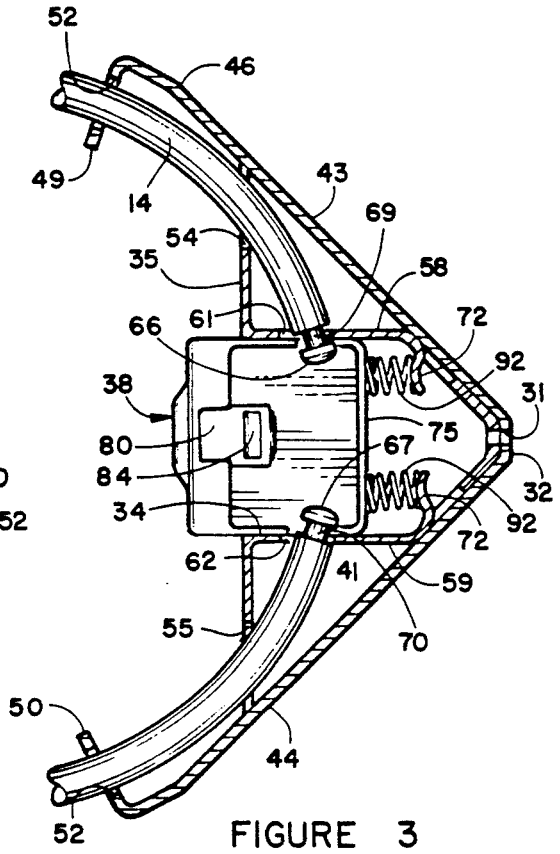
FIG. 3 is a cross sectional view taken along lines 3—3 of FIG. 2.
Figure 2:
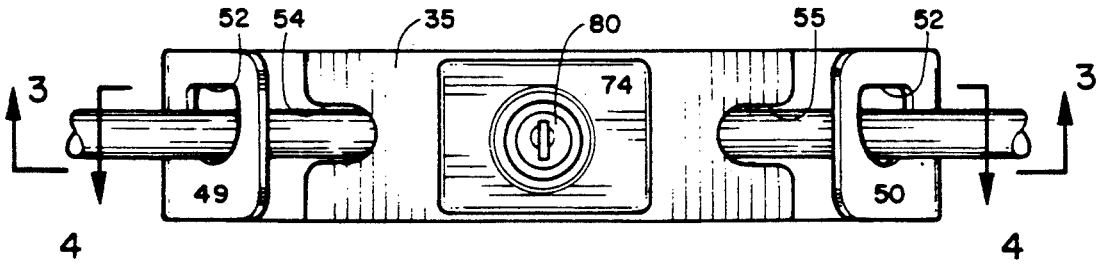
FIG. 2 is a front plan view of the open loop ring housing.

The novel wall mount gun lock assembly will now be described by referring to FIGS. 1-5 of the drawings. The wall mount gun lock assembly is generally designated numeral 10. Its basic components are open loop ring housing 12 and open loop ring 14. This structure may also be used with an alignment shelf 16 having multiple gun barrel recesses 18 that receives the barrel of a rifle 20. A base plate 22 may be positioned below the stock of the rifle.

Figure 4:
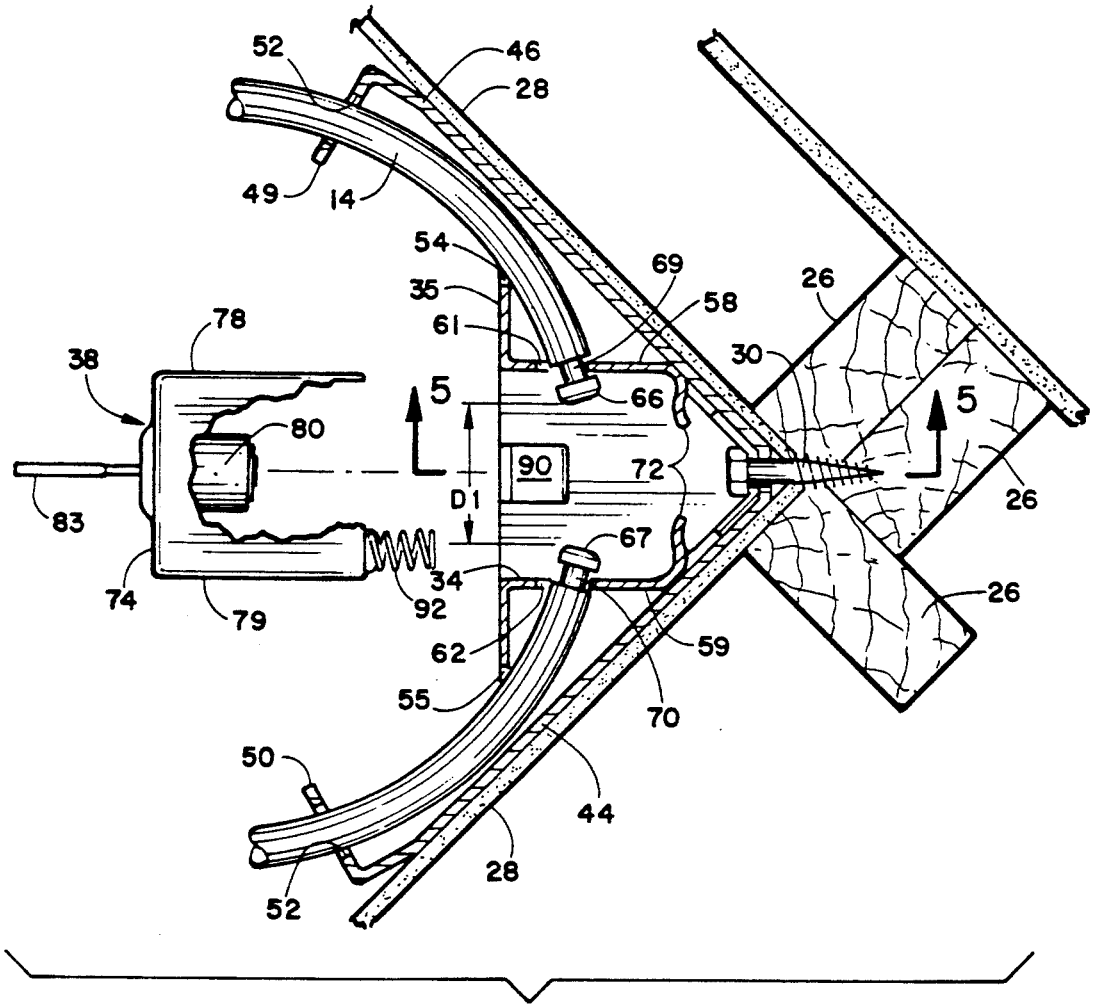
FIG. 4 is a cross sectional view taken along lines 4—4 of FIG. 2.
Figure 5:
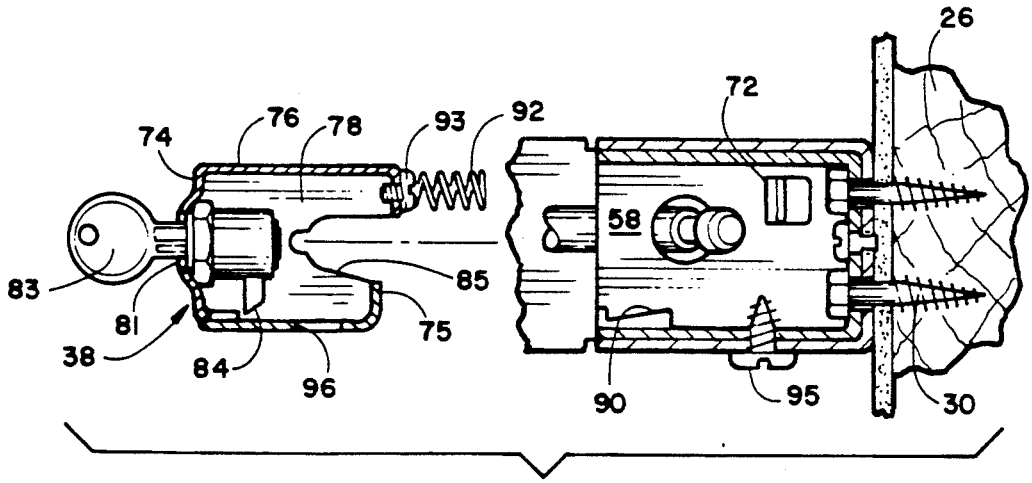
FIG. 5 is an cross sectional view taken along lines 5—5 of FIG. 4.

FIGS. 4 and 5 illustrate the manner in which the open loop ring housing 12 is secured to the walls of a room adjacent its corner. A plurality of studs 26 are secured together in a predetermined manner and have sheet rock panels 28 covering them so they are not seen from the interior of the room. Lag bolts 30 pass through apertures 31 in the rear wall 32 of the open loop ring housing. The only access to the heads of the lag bolts 30 is from the central aperture 34 of front wall 35 of the open loop ring housing. Once key lock housing 38 has been locked in position in central aperture 34, the heads of lag bolts 30 are not visible and there is no way to gain access to them in order to remove the open loop ring housing from the wall of the room.

Open loop ring housing 12 has a substantially triangularly shaped top wall 40 and a substantially triangularly shaped bottom wall 41. Left side wall 43 and right side wall 44 make a substantially 90 degree angle to each other. Left arm portion 46 and right arm portion 47 extend outwardly from the respective side walls 43 and 44. At their respective ends, they have finger portions 49 and 50 each having an opening or slot 52 therein. Front wall 35 also has a left side aperture 54 and a right side aperture 55 through which passes the open loop ring 14. Vertical walls 58 and 59 extend rearwardly from central aperture 34. These walls also have apertures 61 and 62 therein through which pass the end tips 66 and 67 of open loop ring 14. Annular grooves 69 and 70 are formed adjacent the respective end tips. A pair of tangs 72 extend inwardly from the respective side walls 58 and 59.

Key lock housing 38 has a front wall 74, a rear wall 75, a top wall 76, a bottom wall 77, a left side wall 78, and a right side wall 79. A cylinder lock 80 is secured adjacent aperture 81 in front wall 74. It is operated by a key 83. It has a spring loaded latch 84 that is drawn upwardly when the key is turned. Each of these side walls 78 and 79 have a horizontally extending recess or slot 85 that matingly engages the respective annular grooves 69 and 70 of open loop ring 14. When key lock housing 38 is pushed inwardly with its slots 85 aligned with annular grooves 69 and 70, latch 84 will travel over the cam surface of locking plate 90 and drop downwardly locking the key lock housing therein when it is pushed forwardly a sufficient amount. This secures the open loop ring so that it cannot be rotated and none of the fire arms can be removed therefrom. When the key 83 is turned, latch 84 will be withdrawn and the springs 92 mounted by screws 93 on rear wall 75 will cause the key lock housing to be ejected forwardly. This releases the annular grooves of open loop ring 14 from the respective slots 85. A screw 95 passes upwardly through bottom wall 41 and into a longitudinal slot 96 in bottom wall 77. This prevents the springs from completely ejecting key lock housing from central aperture 34.

What is claimed is:

1. A wall mount gun lock assembly comprising:

an open loop ring housing having a top wall, a bottom wall, a front wall, and left and right side walls;

an open loop ring having opposite end tips that are laterally spaced from each other a predetermined distance;

the front wall of said open loop ring housing having a horizontally oriented key lock housing aperture therein, a pair of laterally spaced vertically oriented walls extend rearwardly from said key lock housing aperture;

a key lock housing having a front wall and laterally spaced vertically oriented left and right side walls and said side walls have front edges, said key lock housing being horizontally telescopically removably received in said key lock housing aperture;

said open loop ring housing having aperture means that allows said open loop ring to be rotated through a predetermined path of travel between a first position wherein both of said end tips are positioned within said open loop ring housing and a second position wherein both of said end tips are outside said open loop ring housing thus allowing one of said end tips to be threaded through the trigger guard of a fire arm; and means for releasably capturing the end tips of said open loop ring while they are positioned within said open loop ring housing.

2. A wall mount gun lock assembly as recited in claim 1 further comprising means for securing said open ring housing to the wall of a room.

3. A wall mount gun lock assembly as recited in claim 1 wherein said open loop ring has an arcuate shape.

4. A wall mount gun lock assembly as recited in claim 1 wherein said open loop ring is made of a case hardened steel rod.

5. A wall mount gun lock assembly as recited in claim 1 wherein the top and bottom walls of said open loop ring housing have a substantially triangular shape.

6. A wall mount gun lock assembly as recited in claim 1 wherein the front wall of said open loop ring housing has a left side aperture and a right side aperture through which said open loop ring passes.

7. A wall mount gun lock assembly as recited in claim 1 wherein said means for releasably capturing the end tips of said open loop ring comprises an annular groove adjacent each of the end tips of said open loop ring.

8. A wall mount gun lock assembly as recited in claim 7 wherein said means for releasably capturing the end tips of said open loop ring further comprises a slot in the front edge of each of the side walls of said key lock housing for detachably receiving the respective annular grooves of said open loop ring.

9. A wall mount gun lock assembly comprising:

an open loop ring housing having a top wall, a bottom wall, a front wall, a rear wall and left and right side walls;

an open loop ring having opposite end tips that are laterally spaced from each other a predetermined distance;

the front wall of said open loop ring housing having a key lock housing aperture therein;

a key lock housing having a front wall and laterally spaced upright left and right side walls, said key lock housing being removably received in said key lock housing aperture;

said open loop ring housing having aperture means that allows said open loop ring to be rotated through a predetermined path of travel between a first position wherein both of said end tips are positioned within said open loop ring housing and a second position wherein both of said end tips are outside said open loop ring housing thus allowing one of said end tips to be threaded through the trigger guard of a fire arm;

means for releasably capturing the end tips of said open loop ring while they are positioned within said open loop ring housing; and an arm position extending outwardly from each of said side walls of said open loop ring housing, a finger portion extends from each of said arm portions and they each have an aperture through which said open loop ring passes.

10. A wall mount gun lock assembly comprising:

an open loop ring housing having a top wall, a bottom wall, a front wall, a rear wall and left and right side walls;

an open loop ring having opposite end tips that are laterally spaced from each other a predetermined distance;

the front wall of said open loop ring housing having a key lock housing aperture therein;

a key lock housing having a front wall and laterally spaced upright left and right side walls, said key lock housing being removably received in said key lock housing aperture;

said open loop ring housing having aperture means that allows said open loop ring to be rotated through a predetermined path of travel between a first position wherein both of said end tips are positioned within said open loop ring housing and a second position wherein both of said end tips are outside said open loop ring housing thus allowing one of said end tips to be threaded through the trigger guard of a fire arm;

means for releasably capturing the end tips of said open loop ring while they are positioned within said open loop ring housing; and spring means mounted in said key lock housing that bear against the front end of said key lock housing to eject it whenever the lock is opened.

* * * * *